US006055686A

United States Patent [19]

Knight

[11] Patent Number: 6,055,686

[45] Date of Patent: May 2, 2000

[54] BABY BUNTING FOR USE IN AN INFANT CARRIER

[76] Inventor: Kathryn Knight, 1495 Arlington Dr., Salt Lake City, Utah 84103

[21] Appl. No.: 09/067,717

[22] Filed: Apr. 28, 1998

[51] Int. Cl.[7] ..... A47G 9/00

[52] U.S. Cl. ..... 5/494; 5/413 R; 5/655; 2/69.5

[58] Field of Search ..... 5/494, 413 R, 5/655; 2/69, 69.5

[56] References Cited

U.S. PATENT DOCUMENTS

| | | | |
|---|---|---|---|
| 2,227,751 | 1/1941 | Idelman | 2/69.5 |
| 4,241,458 | 12/1980 | Lesesne . | |
| 4,897,885 | 2/1990 | Lunt . | |
| 4,993,090 | 2/1991 | Ranalli . | |
| 5,058,226 | 10/1991 | Crosby . | |
| 5,243,724 | 9/1993 | Barnes . | |
| 5,437,061 | 8/1995 | Kenner | 2/69 |
| 5,611,095 | 3/1997 | Schneider . | |

*Primary Examiner*—Michael F. Trettel
*Attorney, Agent, or Firm*—Workman, Nydegger & Seeley; David B. Dellenbach

[57] ABSTRACT

A baby bunting which enables a shoulder harness to be fit snug against the infant's clothing to thereby hold the infant securely in the infant carrier, without having to remove the infant from the bunting, wherein the bunting has a contoured shape which enables the shoulder harness to fit closely on top of the infant's shoulders, and has a drawstring through an integral hood of the bunting which draws the hood around the infant's face so as to fit snugly while preventing the drawstring from getting near to the infant's mouth.

21 Claims, 5 Drawing Sheets

BABY BUNTING FOR USE IN AN INFANT CARRIER

BACKGROUND

1. The Field of the Invention

The present invention relates generally to a bunting or infant covering. More specifically, the present invention provides a bunting which is adaptable so that it can be easily installed in numerous infant carrying devices, where the bunting has advantageous features which make it safer to use, and where the bunting can be removed from the infant carrier with the infant still inside, thereby protecting the infant from the elements with minimal exposure, and finally, can be opened flat to use as a blanket.

2. The State of the Art

State of the art baby buntings are generally desired to try and protect an infant from exposure to the elements. To accomplish this, the buntings are supposed to wrap around an infant to thereby form a covering which keeps the infant warm and dry. However, when the buntings are used in conjunction with infant carriers, a new set of problems present themselves. It is desirable to be able to have the infant inside the bunting, but for the bunting not to interfere with securing the infant inside it to the infant carrier. Unfortunately, existing buntings are not easily attached to or removed from infant carriers when the infant is already inside. In other words, some buntings require that they be attached to the infant carrier without the baby inside, thus eliminating most of the advantages of using the bunting. Alternatively they require the shoulder harness to fit over the bunting with the infant inside, thus providing a less secure means of fastening an infant in its carrier.

A brief and more specific summary of the state of the art in baby buntings is useful to understand the specific drawbacks and shortcomings which the present invention overcomes. Beginning with U.S. Pat. No. 4,993,090 issued to Ranalli (the '090 patent), the bunting is nothing more than an unshaped blanket which is placed into an infant carrier. Slits at shoulder height and at the crotch permit a shoulder harness to pass through the bunting and over the infant. The bunting is then simply folded around the infant without means of more securely closing and preventing the infant from wiggling out from underneath the bunting. Another particularly disadvantageous feature is that the infant can not be in the bunting when it is placed in the infant carrier.

U.S. Pat. No. 5,243,724 issued to Barnes (the '724 patent) provided some improvements over the '090 patent in that means were provided for securing the bunting around the infant. The securing means was typically a VELCRO strip. Furthermore, in place of slits through the bunting for a shoulder harness to fit through, the shoulder harness fit around the outside of the bunting, and through two slits in the bunting at the crotch. Disadvantageously, however, the bunting is simply a square piece of fabric. Consequently, when the bunting is folded over the infant and secured, the upper torso of the infant is not covered, leaving the infant exposed.

U.S. Pat. No. 5,611,095 issued to Schneider (the '095 patent) teaches a shaped bunting with a detachable hood. Unfortunately, the bunting also includes the slits where a shoulder harness is passed and secured between the infant's legs, thus requiring the infant to be removed from the bunting when it is secured to the infant carrier. The bunting is also split at the bottom half to enable the shoulder harness to be attached at the crotch, and the bunting is folded up around the infant's legs.

Finally, U.S. Pat. No. 4,241,458 issued to Lesesne (the '458 patent) teaches a bunting which is disadvantageously attached to an infant carrier device via slits through the back of the bunting. These slits permit straps from the infant carrier to pass through the bunting and to be secured around the infant and to a crotch attachment while the bunting is open. The bunting is then zipped closed. Unfortunately, drawstrings at the top and bottom of the bunting used to close the ends thereof are left free. The top drawstrings can be pulled into the infant's mouth, thereby posing a choking hazard.

Accordingly, it would be an advantage over the state of the art to provide a baby bunting by which an infant can be transported to and from an infant carrier (car seat, stroller, etc.). The bunting should enable a shoulder harness to secure the infant within the infant carrier without having to remove the infant from the bunting. The shoulder harness should fit snugly against the infant's clothing instead of the bunting so that the infant is more securely held within the infant carrier. The bunting should require minimal exposure of the infant to the elements when fastening the shoulder harness around the infant. The bunting should have an integral hood which can be drawn to snugly fit around the infant's face, but the mechanism for drawing the hood should not be accessible to the infant. The bunting should also lay out flat when not in the infant carrier so that it can be used as a blanket.

OBJECTS AND SUMMARY OF THE INVENTION

It is an object of the present invention to provide a baby bunting which is formed such that a shoulder harness can fit around a hood portion and attach to the infant carrier through a slit in the bunting, the shoulder harness fitting snug against the infant's clothing.

It is another object to provide a baby bunting which minimizes exposure of the infant to the outside elements when securing the bunting and the infant to the infant carrier.

It is another object to provide a baby bunting which has a shaped hood portion which can be drawn snug around an infants face, where the means for drawing the hood snug are kept away from the infant's mouth.

It is another object to provide a baby bunting which can be securely fastened around the infant, and yet permit the infant to move arms and legs within the confines of the bunting without the possibility of becoming uncovered.

It is another object to provide a baby bunting which can be shaped to conform to the infant's body through drawstrings at the top and bottom, and a securing means between the two sides, and yet can lay flat when unsecured and the drawstrings loosened.

It is another object to provide a baby bunting which is simple to secure around an infant and to the infant carrier.

It is another object to provide a baby bunting which is not bulky and therefore permits the infant to move arms and legs within the bunting.

The present invention is realized in a baby bunting which enables a shoulder harness to be fit snug against the infant's clothing to thereby hold the infant securely in the infant carrier, without having to remove the infant from the bunting.

In a first aspect of the invention, the bunting has a contoured shape, where the contoured hood portion enables the shoulder harness to fit closely on top of the infant's shoulders.

In a second aspect of the invention, a drawstring through the hood of the bunting draws the hood so as to fit snugly around the infant's face, and is kept away from the infant's mouth through flaps which securely hold the ends of the drawstring.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention. It is to be understood that the following description is only exemplary of the principles of the present invention, and should not be viewed as narrowing the claims which follow.

Figure 1:
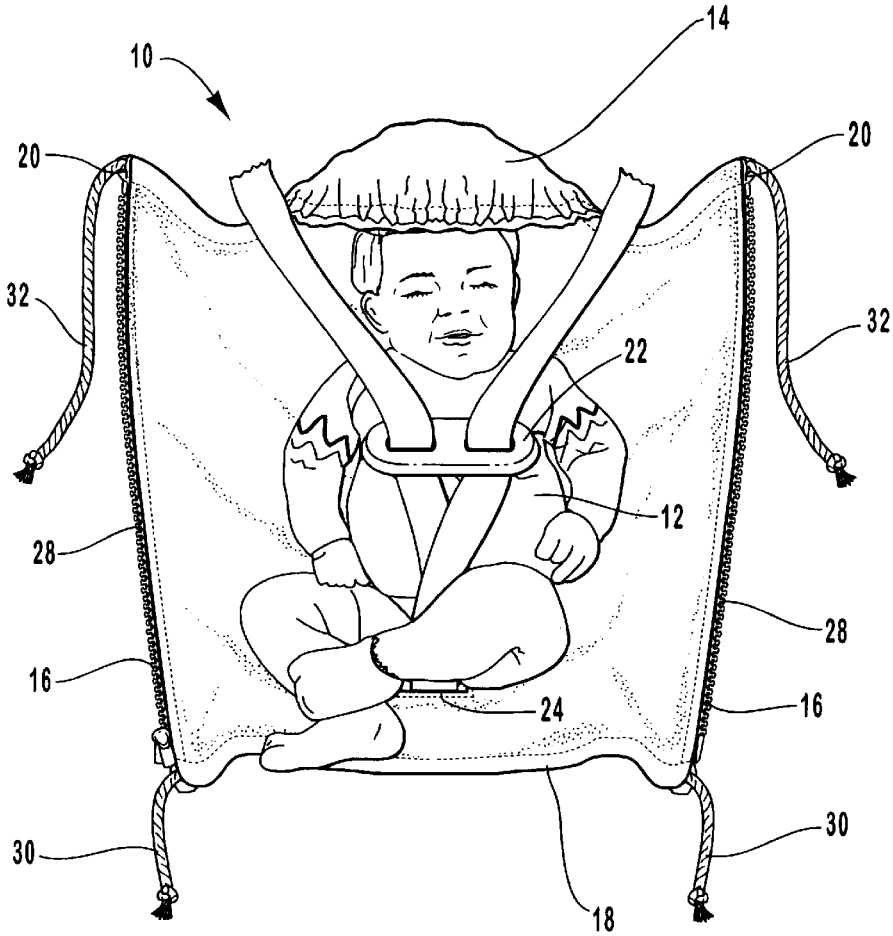
FIG. 1 is a plan view of one embodiment which is made in accordance with the principles of the present invention, where the figure shows an outline of an infant in relation to the bunting.

FIG. 1 is a plan view of an embodiment constructed in accordance with the principles of the present invention. The shape of the bunting 10 is shown relative to the form of an infant 12 drawn on top of the bunting 10. The bunting 10 is comprised of a hood portion 14, two vertical edges 16 and a bottom edge 18. The bunting 10 is shown as it appears when laid flat. Thus, although contoured to fit snugly around the infant 12, it is advantageously capable of being laid out as a blanket when not in the infant carrier.

The hood portion 14 of the bunting 10 is contoured such that when the two vertical edges 16 are brought together, the base of the hood portion 14, shown generally at 20, is close to the infant's neck. In this way, drawing a shoulder harness 22 up and over the hood portion 14 enables the shoulder harness to be positioned correctly around the infant's neck and shoulder area. The straps should be far enough apart to let the infant move its head comfortably, but not so loose that the infant would pop out and up between the straps should a car stop suddenly and the infant carrier were a car seat.

At this point, it is important to realize that the cited prior art has many drawbacks in this aspect of the invention. The '090 and the '095 patents teach that the shoulder harness 22 must pass through the bunting, and the '458 patent does not accommodate a shoulder harness. Only the '724 patent teaches a similar arrangement, but without contouring the bunting. This results in a bunting which is bunched up around the infant's head, making the infant uncomfortable and the bunting less form fitting.

The shoulder harness 22 is secured to the infant carrier generally at a harness attachment located in the infant carrier and between the infant's legs, generally around the crotch. Accordingly, a hole or perforation 24 is made in the bunting to permit the shoulder harness to couple to the harness attachment.

Another advantage of the invention at this point is that although the shoulder harness 22 is brought from outside the bunting 10 and around the infant's head, the straps of the shoulder harness 22 are able to press down directly on the infant's clothing to secure the infant within the infant carrier. This is accomplished by unfastening the vertical edges 16, and coupling the shoulder harness 22 to the harness attachment through the perforation 24. The vertical edges 16 are then fastened together using any appropriate fastening means. In this embodiment, a zipper 28 is used. However, the fastening means could be buttons, VELCRO, snaps or any other convenient mechanism.

A quick comparison to the prior art shows that the '090, the '724 and the '458 patents all show a similarly located perforation 24, and the '095 patent teaches a slit all the way from the bottom of the bunting to the location of the harness attachment. However, the '090 patent and the '095 patent teach a bunting which is difficult to use because the shoulder harness has to fit through the bunting, and in the '458 patent the waist harness also must pass through the bunting. In contrast, the '724 patent teaches a bunting in which the shoulder harness fits around an unshaped hood portion, and also fits over the bunting and is coupled to the harness attachment through two layers of the bunting. Accordingly, the shoulder harness 22 does not fit snug against the infant, but rather against the bulk of the bunting, resulting in the infant being less secure in the infant carrier.

Now that the infant is secured within the infant carrier in accordance with this embodiment, the vertical edges 16 are fastened together as described previously. Advantageously, a first drawstring 30 is provided at a bottom end, and a second drawstring 32 is provided around a contoured edge of the hood portion 14.

The drawstrings 30 and 32 are provided so that the infant is kept warm by closing off the infant from as much of the elements as possible, while providing a comfortable breathing space around the infant's face. However, only the '458 patent teaches a drawstring for closing the ends of the bunting. Disadvantageously however, the drawstring around the top portion of the bunting is not secured. In other words, after the drawstring is tied, the ends of the drawstring lie in front of the infant's face. As the infant is growing and trying to place object's in its mouth, the dangling ends of the drawstring present an attractive and dangerous temptation. Eventually, the infant will be capable of putting the drawstring into its mouth, by accident or deliberate effort.

Figure 2:
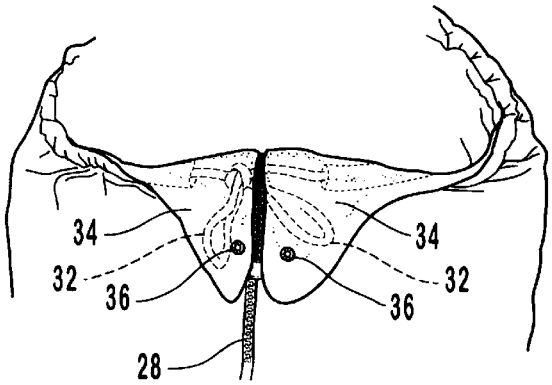
FIG. 2 is a detailed close-up plan view of the bunting with flaps which fold down and attach to the bunting to thereby cover a drawstring which could otherwise be drawn into the infant's mouth. The flaps are located generally at the top of the infant's chest.

Advantageously, this embodiment teaches a means for securing the drawstring 32 such that the infant can not reach it. The specific mechanism for securing the drawstring are flaps 34 as shown in FIG. 2. These flaps 34 are simply folded down over the drawstring 32 and secured to the bunting 10 by snaps, VELCRO, buttons or any other convenient means. It is not even necessary that the flaps 34 completely cover the drawstring 32. What is important is that the drawstring 32 be kept far enough from the infant's mouth so it can not be reached. The flaps 34 can cross over the zipper, or fold down parallel to the zipper.

Figure 3:
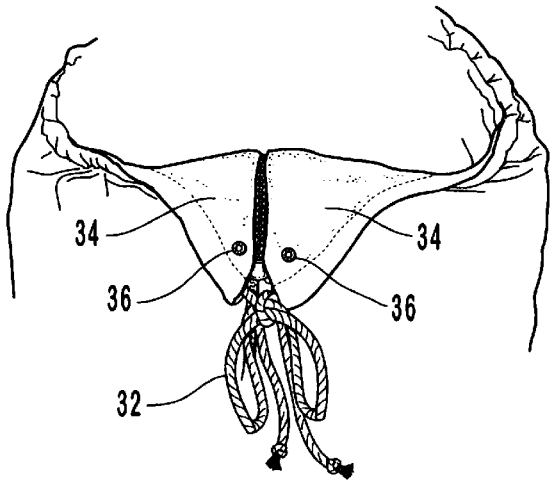
FIG. 3 is a detailed close-up plan view of the bunting with flaps, where the drawstring now follows the contours of the flaps so that when the flaps are secured to the bunting, the drawstrings are too far from the infant's mouth to be reached.

In an alternative embodiment shown in FIG. 3, the drawstring 32 is made to follow the contours of the flaps 34 as does piping on fabric. For the drawstring 32 to still function properly, the flaps 34 must be able to be secured to the bunting 10. Otherwise, the flaps will just move up toward the infant's mouth. Accordingly, the same means 36 for securing the flaps 34 over the drawstring 32 and to the bunting 10 must also be applied in this embodiment. The flaps may be folded down parallel to the zipper as described previously, and then the drawstring drawn tight or, alternatively, the drawstring may be drawn tight and then the loose ends of the string may be rolled up into the flaps as the flaps are rolled down to fasten to the bunting 10, parallel to the zipper.

The bunting of the present invention provides several important advantages over the state of the art. An infant can be carried to and from an infant carrier while inside the bunting. When a shoulder harness is used to secure the infant inside the infant carrier, the bunting is unfastened so that the shoulder harness is brought down over the infant's head and inside the bunting where it passes through a perforation and is coupled to the harness attachment. The shoulder harness is now snug against the infant, without the interference of the bunting. The shaped hood portion enables the shoulder harness to fit properly around the infant's head and shoulders. Then the bunting is fastened again, with the shoulder harness partially inside. In this embodiment, the first drawstring is tightened around the infant's face. Then the flaps are pulled down over the ends of the drawstring to secure them away from the infant's mouth.

In an alternative embodiment, the flaps are first secured against the bunting, and then the drawstring is tightened. By threading the drawstring through the edges of the flaps as well as around the hood portion of the bunting, the drawstring is naturally positioned away from the infant's mouth.

The infant is free to wiggle arms and legs within the warm confines of the bunting because it does not constrict the infant. This is accomplished by the bunting by not being formed to the arms and legs, but around the infant's entire body.

When the infant is inside shelter and away from the elements, the first and second drawstrings can be loosened. In this state, the bunting 10 is able to lie out flat because the contouring of the bunting to the infant is strictly a result of the drawstrings forcing the bunting to fit itself to the infant.

Figure 4A:
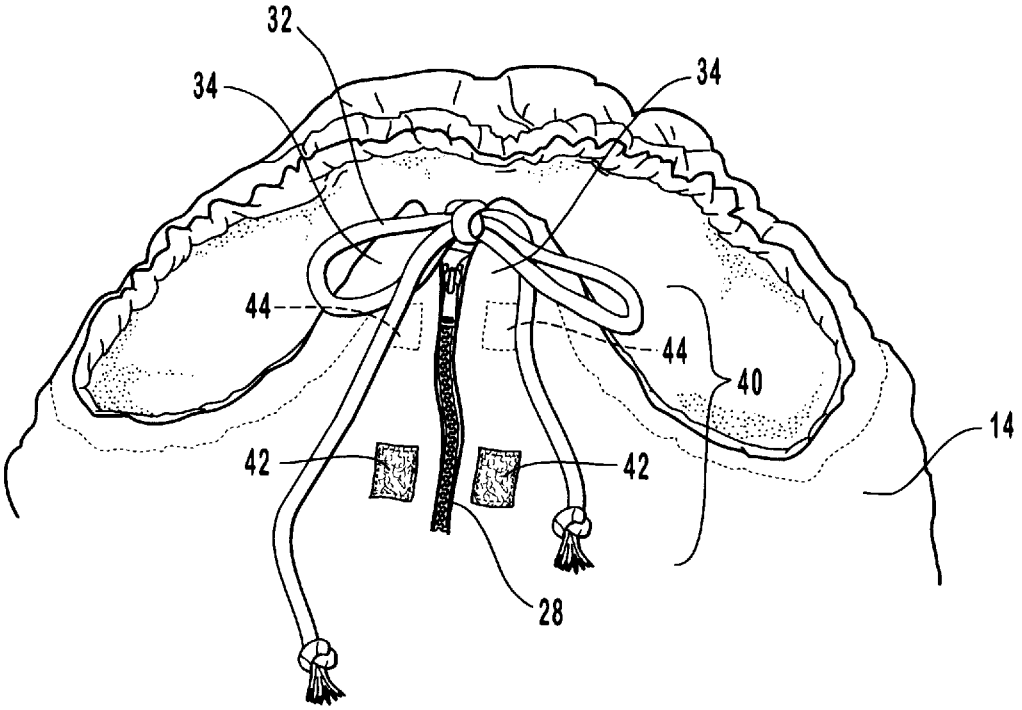
FIG. 4A is a profile view of the preferred embodiment for placement of the drawstrings and of a means for securing the bunting's flaps to the bunting. The flaps are shown unfolded to reveal the structure of the flaps and the placement of the securing means.

FIG. 4A is a profile view of the presently preferred embodiment for placement of the drawstrings 32 in the bunting 14, and for the means 40 for securing the bunting's flaps 34 to the bunting. This preferred embodiment places the drawstrings 32 around the edge of the flaps 34 just as in FIG. 3. The flaps 34 are shown as they appear before they are moved from in front of the infant's face. What is important to notice is the placement of the presently preferred securing means 40. In this preferred embodiment, VELCRO is used to secure the flaps 34 to the bunting 14.

In this preferred embodiment, 2 sets of VELCRO tabs 42 and 44 are used to secure the flaps 34 to the bunting 14, one set on each side of the zipper 28. When the zipper 28 is closed, it is noted that two VELCRO tabs 42 are visible, and two VELCRO tabs 44 are hidden. When the drawstring 32 has been tied, the flaps 34 are now rolled as shown in FIG. 4B.

Figure 4B:
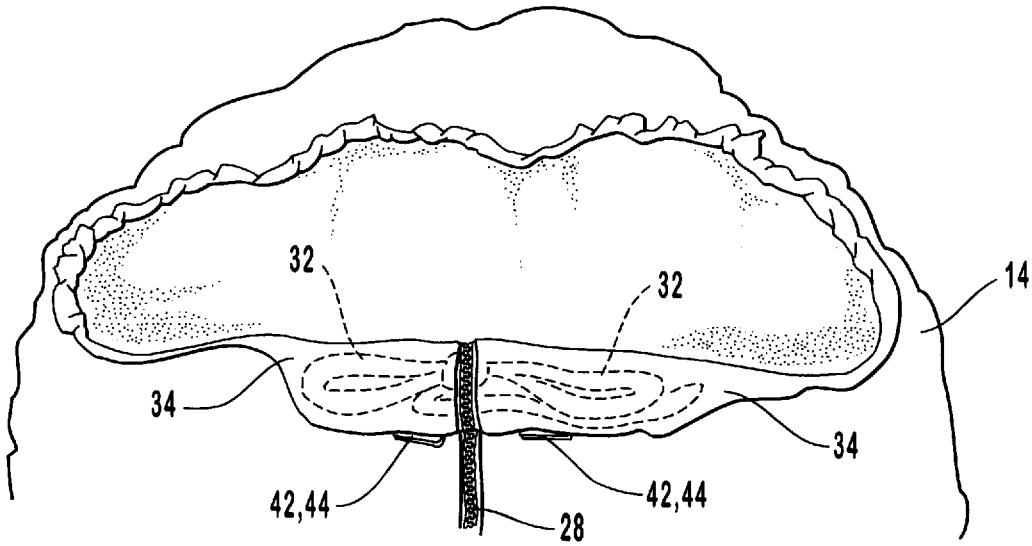
FIG. 4B is profile view of the preferred embodiment of FIG. 4A, where the flaps are now rolled and attached to the bunting using the securing means.

FIG. 4B is profile view of the presently preferred embodiment of FIG. 4A, where the flaps 34 are now rolled and attached to the bunting 14 using the VELCRO tabs 42 and 44. FIG. 4B illustrates that the flaps 34 are rolled by curling the flaps 34 away from the infant's face, which would thus be outwardly away from the surface of the paper. Advantageously, the drawstrings 32 are rolled up within the flaps 34. As the flaps 34 are rolled, the hidden VELCRO tabs 44 are exposed to the view of the person rolling the flaps 34. The VELCRO tabs 42 and 44 are positioned on the flaps 34 and the bunting 14 such that the previously hidden VELCRO tabs 44 will meet and attach to the exposed set of VELCRO tabs 42 on the bunting 14. FIG. 4B only shows the tabs 42 and 44 and the drawstrings 32 in outline because they are respectively hidden underneath or inside the rolled flaps 34.

Figure 5A:
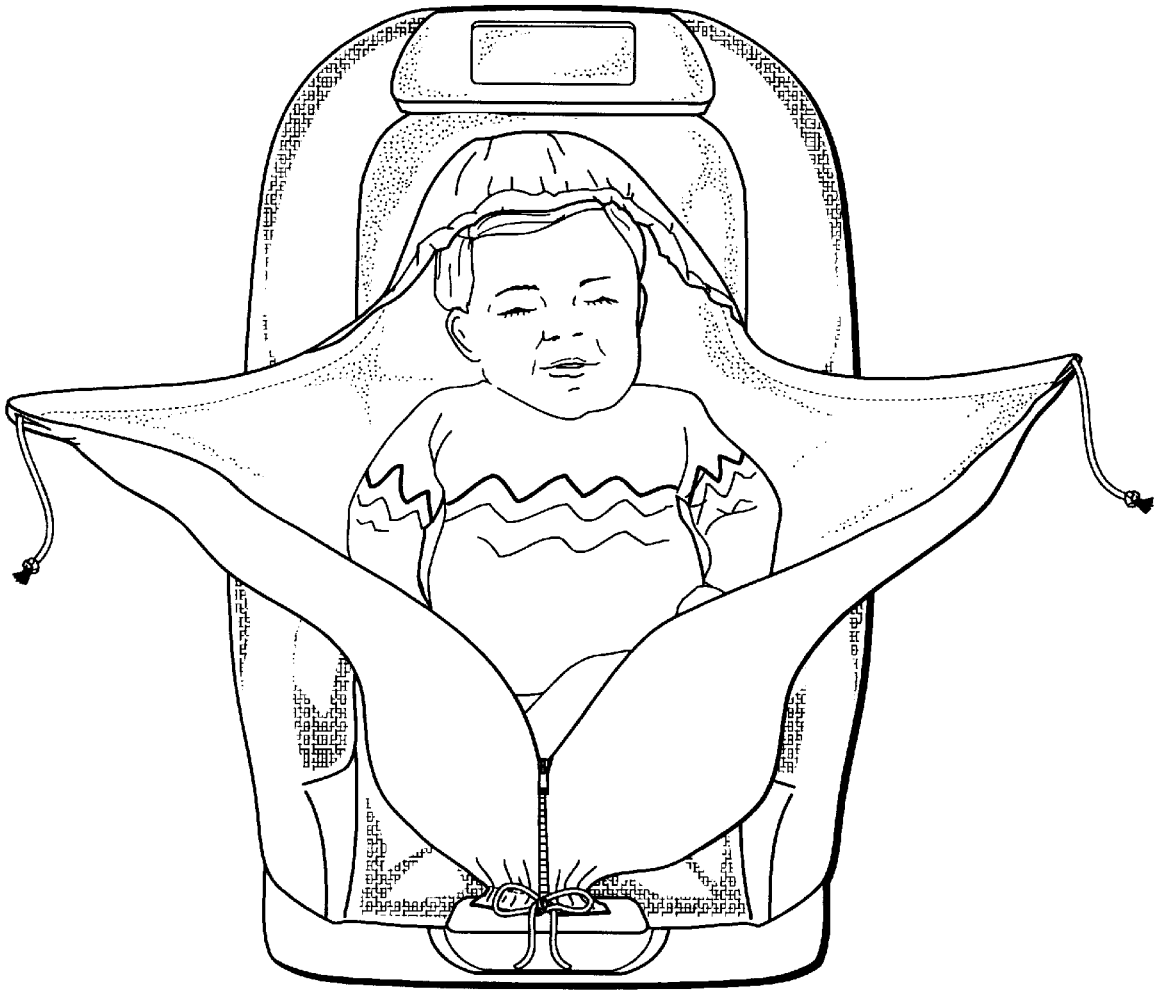
FIG. 5A is a front profile view of an infant carrier having the bunting disposed therein, and an infant sitting on the bunting.

FIG. 5A is a front profile view of an infant carrier having the bunting disposed therein, and an infant sitting on the bunting. The front closure and drawstrings are open and loose.

Figure 5B:
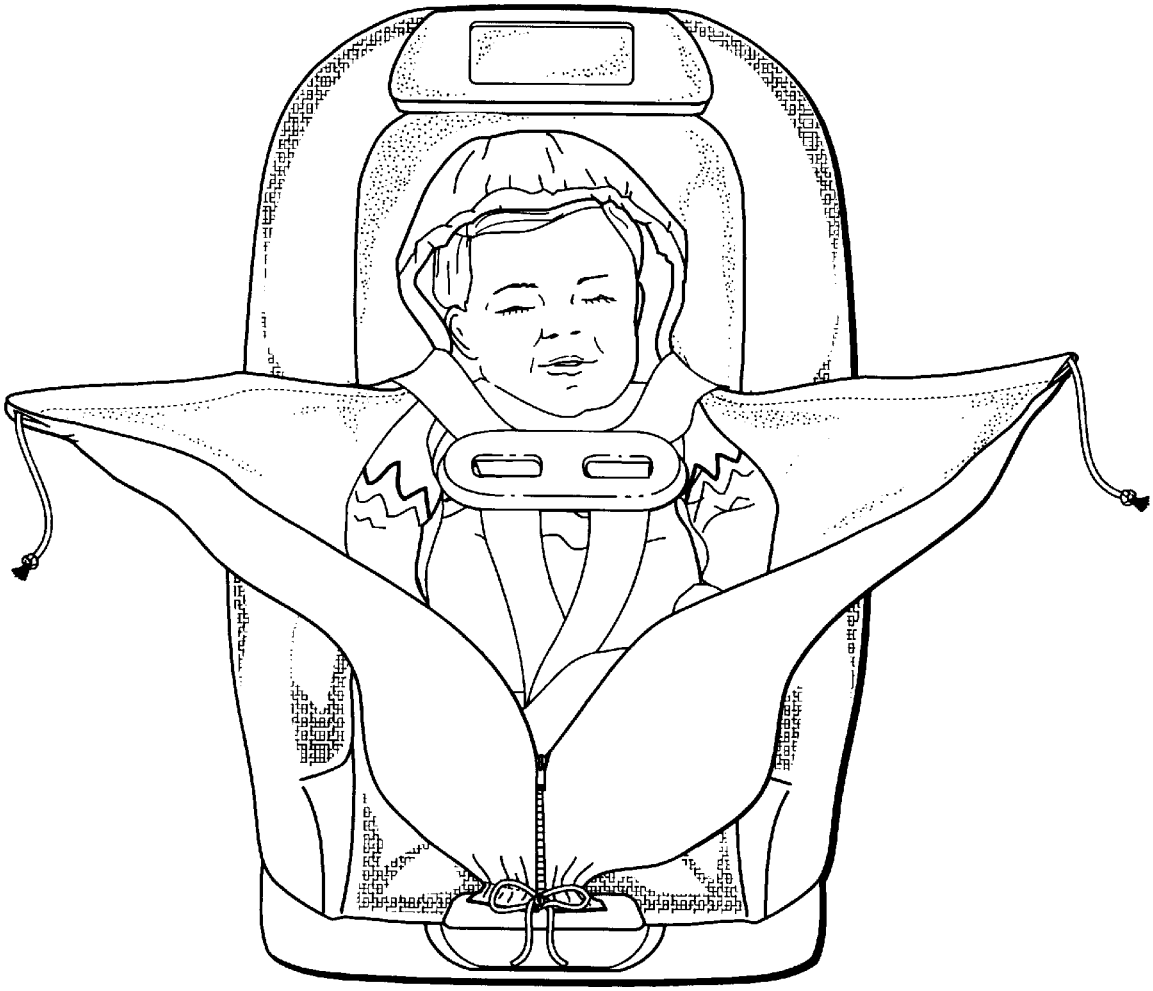
FIG. 5B is a front profile view of FIG. 5A where the shoulder harness is pulled over the infant's head and integral hood of the bunting, and attached to the infant carrier through a perforation in the bunting located at the infant's crotch.

FIG. 5B is a front profile view of FIG. 5A where the shoulder harness is pulled over the infant's head and integral hood of the bunting, and attached to the infant carrier through a perforation in the bunting located at the infant's crotch.

Figure 5C:
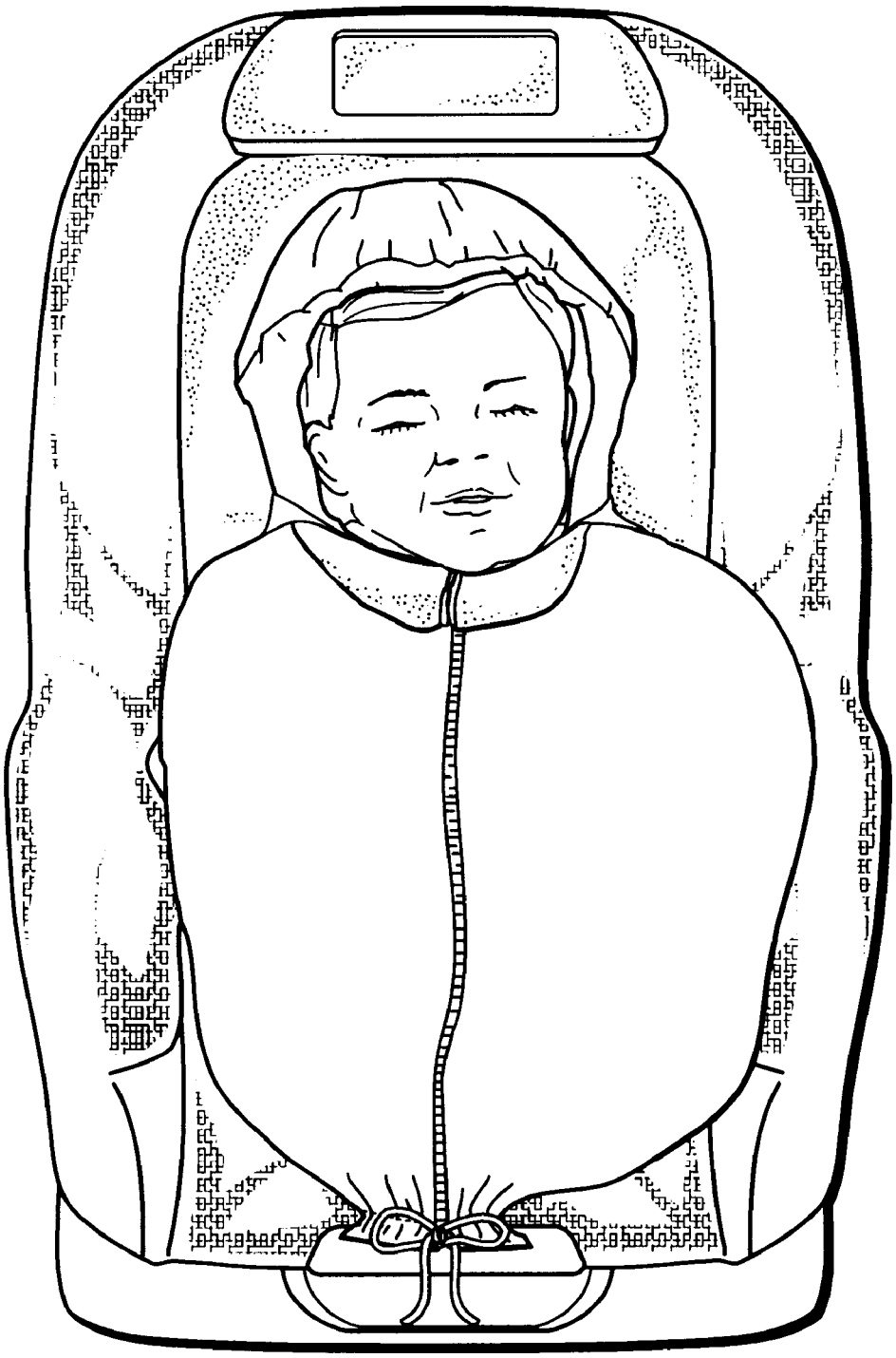
FIG. 5C is a front profile view of FIG. 5B where the front closure has been secured over the infant and the shoulder harness, the bottom edge drawstring is drawn closed.

FIG. 5C is a front profile view of FIG. 5B where the front closure has been secured over the infant and the shoulder harness, the bottom edge drawstring is drawn closed. The integral hood drawstring is not yet closed and secured underneath the flaps (not shown).

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A bunting which is attachable to an infant carrier, wherein the bunting enables a shoulder harness on the infant carrier to be secured directly against an infant's clothing without interference from the bunting, said bunting comprising:

a portion of fabric having a contoured top edge forming an integral hood, two opposing lengthwise edges, a bottom edge, and a first side and a second side, wherein the first side is disposed against the infant carrier, and wherein the second side is disposed so as to receive an infant;

a first closing means disposed at the bottom edge and capable of at least partially closing a bottom portion of the bunting;

a second closing means disposed on the two opposing lengthwise edges, and extending from the bottom edge a distal distance along the two opposing lengthwise edges;

a third closing means disposed on the integral hood and capable of at least partially closing the integral hood; and a perforation in the bunting disposed nearer the bottom edge and generally centered between the two opposing edges, wherein the perforation extends from the first side through to the second side; and wherein the shoulder harness is pulled over the integral hood and coupled to a harness coupling disposed in the infant carrier generally beneath the perforation; and wherein the two opposing edges are secured by the second closing means with the shoulder harness being covered by the bunting beginning generally above a chest of the infant;

wherein the third closing means further comprises a first drawstring disposed generally along the contoured top edge forming the integral hood, wherein pulling ends of the first drawstring results in at least partial closing of the integral hood and wherein the bunting further comprises:

a first flap of additional material disposed on the bunting where a right edge of the two opposing edges ends and the integral hood begins, said first flap extending a strip of the bunting which is generally parallel to the two opposing edges, and whose contours the first drawstring does not follow;

a second flap of additional material disposed on the bunting where a left edge of the two opposing edges ends and the integral hood begins, said second flap extending a strip of the bunting which is generally parallel to the two opposing edges, and whose contours the first drawstring does not follow;

means for securing the first flap to the bunting when it is folded back upon itself, and wherein the first flap at least partially covers the ends of the first drawstring so that they are difficult to reach by an infant in the bunting; and means for securing the second flap to the bunting when it is folded back upon itself, and wherein the second flap at least partially covers the ends of the first drawstring so that they are difficult to reach by an infant in the bunting.

2. The bunting as defined in claim 1 wherein the bunting further comprises means for securing the first flap and the second flap to the bunting after both are caused to cross over the second closing means which secures the two opposing edges together.

3. The bunting as defined in claim 1 wherein the means for securing the first flap to the bunting and the means for securing the second flap to the bunting are selected from the group of means for securing defined as buttons, snaps and a hook and loop fastener.

4. A bunting which is attachable to an infant carrier, wherein the bunting enables a shoulder harness on the infant carrier to be secured directly against an infant's clothing without interference from the bunting, said bunting comprising:

a portion of fabric having a contoured top edge forming an integral hood, two opposing lengthwise edges, a bottom edge, and a first side and a second side, wherein the first side is disposed against the infant carrier, and wherein the second side is disposed so as to receive an infant;

a first closing means disposed at the bottom edge and capable of at least partially closing a bottom portion of the bunting;

a second closing means disposed on the two opposing lengthwise edges, and extending from the bottom edge a distal distance along the two opposing lengthwise edges;

a third closing means disposed on the integral hood and capable of at least partially closing the integral hood; and a perforation in the bunting disposed nearer the bottom edge and generally centered between the two opposing edges, wherein the perforation extends from the first side through to the second side; and wherein the shoulder harness is pulled over the integral hood and coupled to a harness coupling disposed in the infant carrier generally beneath the perforation; and wherein the two opposing edges are secured by the second closing means with the shoulder harness being covered by the bunting beginning generally above a chest of the infant;

wherein the third closing means further comprises a first drawstring disposed generally along the contoured top edge forming the integral hood, wherein pulling ends of the first drawstring results in at least partial closing of the integral hood and wherein the bunting further comprises:

a first flap of additional material disposed on the bunting where a right edge of the two opposing edges ends and the integral hood begins, said first flap extending a strip of the bunting which is generally parallel to the two opposing edges, and whose contours the first drawstring follows;

a second flap of additional material disposed on the bunting where a left edge of the two opposing edges ends and the integral hood begins, said second flap extending a strip of the bunting which is generally parallel to the two opposing edges, and whose contours the first drawstring follows;

means for securing the first flap to the bunting when it is folded back upon itself, and wherein the first flap at least partially covers the ends of the first drawstring so that they are difficult to reach by an infant in the bunting; and means for securing the second flap to the bunting when it is folded back upon itself, and wherein the second flap at least partially covers the ends of the first drawstring so that they are difficult to reach by an infant in the bunting.

5. The bunting as defined in claim 4 wherein the means for securing the first flap to the bunting and the means for securing the second flap to the bunting are selected from the group of means for securing defined as buttons, snaps and a hook and loop fastener.

6. A bunting which is attachable to an infant carrier, wherein the bunting enables a shoulder harness on the infant carrier to be secured directly against an infant's clothing without interference from the bunting, said bunting comprising:

a portion of fabric having a contoured top edge forming an integral hood, two opposing lengthwise edges, a bottom edge, and a first side and a second side, wherein the first side is disposed against the infant carrier, and wherein the second side is disposed so as to receive an infant;

a first closing means disposed at the bottom edge and capable of at least partially closing a bottom portion of the bunting;

a second closing means disposed on the two opposing lengthwise edges, and extending from the bottom edge a distal distance along the two opposing lengthwise edges;

a third closing means disposed on the integral hood and capable of at least partially closing the integral hood; and a perforation in the bunting disposed nearer the bottom edge and generally centered between the two opposing edges, wherein the perforation extends from the first side through to the second side; and wherein the shoulder harness is pulled over the integral hood and coupled to a harness coupling disposed in the infant carrier generally beneath the perforation; and wherein the two opposing edges are secured by the second closing means with the shoulder harness being covered by the bunting beginning generally above a chest of the infant;

wherein the second closing means extends generally from the bottom edge to the integral hood along the two opposing edges and wherein the second closing means is selected from the group of closing means defined as zippers, snaps, buttons and a hook and loop fastener.

7. A bunting which is attachable to an infant carrier, wherein the bunting enables a shoulder harness on the infant carrier to be secured directly against an infant's clothing without interference from the bunting, said bunting comprising:

a portion of fabric having a contoured top edge forming an integral hood, two opposing lengthwise edges having a first flap and a second flap, a bottom edge, and a first side and a second side, wherein the first side is disposed against the infant carrier, wherein the second side is disposed so as to receive an infant, and wherein the first and the second flaps are strips of the bunting which are generally parallel to and extended from the two opposing edges;

a first closing means disposed on the two opposing lengthwise edges, and extending from the bottom edge a distal distance along the two opposing lengthwise edges;

a first drawstring disposed within and along contours of the integral hood and the first and the second flaps and capable of at least partially closing the integral hood; and means for securing the first and the second flaps to the bunting when they are folded back upon themselves, and wherein the first and the second flaps at least partially cover the ends of the first drawstring so that they are difficult to reach by an infant in the bunting.

8. The bunting as defined in claim 7 wherein the bunting further comprises a second closing means disposed at the bottom edge and capable of at least partially closing a bottom portion of the bunting.

9. The bunting as defined in claim 8 wherein the second closing means further comprises a second drawstring disposed generally along the bottom edge, wherein pulling ends of the second drawstring results in the bottom portion of the bunting at least partially closing.

10. The bunting as defined in claim 7 wherein the bunting further comprises a perforation in the bunting disposed nearer the bottom edge and generally centered between the two opposing edges, wherein the perforation extends from the first side through to the second side; and wherein the shoulder harness is pulled over the integral hood and coupled to a harness coupling disposed in the infant carrier generally beneath the perforation; and wherein the two opposing edges are secured by the first closing means with the shoulder harness being covered by the bunting beginning generally above the infant's chest.

11. The bunting as defined in claim 7 wherein the bunting further comprises a means for securing the first flap and the second flap to the bunting after the first and the second flaps are caused to cross over the first closing means which secures the two opposing edges together.

12. The bunting as defined in claim 7 wherein the means for securing the first flap and the second flap to the bunting are selected from the group of means for securing defined as buttons, snaps and a hook and loop fastener.

13. The bunting as defined in claim 7 wherein the first closing means extends generally from the bottom edge to the integral hood along the two opposing edges.

14. The bunting as defined in claim 13 wherein the first closing means is selected from the group of closing means defined as zippers, snaps, buttons and a hook and loop fastener.

15. A method for providing a baby bunting which can be securely coupled to an infant carrier, wherein an infant carrier harness is able to fit snugly against an infant's clothing, and wherein exposure of the infant to weather is minimized while placing the infant and bunting in and removing the infant from the infant carrier, said method comprising the steps of:

(1) providing a bunting having a front closure means, an integral hood portion, and a perforation which allows the infant carrier harness to pass a coupling mechanism through the bunting;

(2) placing the bunting with the infant inside on the infant carrier;

(3) opening the front closure means of the bunting;

(4) disposing the infant carrier harness over an infant's head and down over an infant's chest, and securing the infant carrier harness to the infant carrier through the perforation in the bunting; and (5) fastening the front closure means over the infant and the infant carrier harness up to the integral hood portion, thereby providing protection from weather while maintaining the infant carrier harness close to the infant without interference from bulkiness of the bunting.

16. The method as defined in claim 15 wherein the method further comprises the steps of:

(1) providing at least one flap on the bunting at a location where the front closure means meets the integral hood portion;

(2) providing a first drawstring through the integral hood such that the integral hood can be partially closed around the infant's face to keep the infant warm; and (3) folding the at least one flap over the first drawstring and against the bunting to thereby prevent the infant from pulling the first drawstring into its mouth.

17. The method as defined in claim 16 wherein the method further comprises the steps of providing a second drawstring through a bottom edge of the bunting such that the bunting can be closed at the bottom edge.

18. The method as defined in claim 16 wherein the method further comprises the step of providing a bunting which enables the infant to move arms and legs and head freely within the confinement of the infant carrier harness with minimal exposure to the weather.

19. The method as defined in claim 15 wherein the method further comprises the steps of:

(1) unfastening the front closure means of the bunting;

(2) untying the first drawstring; and (3) laying the bunting out so that it can be used as a blanket upon which the infant can rest or play.

20. A method for providing a baby bunting which can be securely coupled to an infant carrier, wherein exposure of the infant to weather is minimized by securing openings in the bunting and preventing access to the infant to the means for securing the openings, said method comprising the steps of:

(1) providing a bunting having a front closure means and an integral hood portion;

(2) placing the bunting with the infant inside on the infant carrier;

(3) securing the bunting and the infant to the infant carrier;

(4) providing at least one flap on the bunting generally at a location where the front closure means meets the integral hood portion;

(5) providing a first drawstring through the integral hood such that the integral hood can be partially closed around the infant's face to keep the infant warm; and (6) folding the at least one flap over the first drawstring and against the bunting to thereby prevent the infant from pulling the first drawstring into its mouth.

21. The method as defined in claim 20 wherein the method further comprises the step of disposing the first drawstring through the at least one flap such that when the at least one flap is folded against the bunting and therefore away from the integral hood, the first drawstring is not accessible to the infant.

* * * * *

UNITED STATES PATENT AND TRADEMARK OFFICE

CERTIFICATE OF CORRECTION

PATENT NO. : 6,055,686

DATED : May 2, 2000

INVENTOR(S) : Kathryn Knight

It is certified that error appears in the above-identified patent and that said Letters Patent are hereby corrected as shown below:

Col. 8, ln. 18: after "integral" change "hood" to --hood;--

Signed and Sealed this

Twenty-second Day of May, 2001

*Attest:*

Nicholas P. Godici

NICHOLAS P. GODICI

*Attesting Officer*

*Acting Director of the United States Patent and Trademark Office*